US005682710A

United States Patent [19]

Davies et al.

[11] Patent Number: 5,682,710

[45] Date of Patent: Nov. 4, 1997

[54] PARALLEL BALANCE SYSTEM

[75] Inventors: Bob Davies; Shawn Davies; Shaul Goldenberg, all of Weston, Canada

[73] Assignee: 420820 Ontario Limited, Vaughan, Canada

[21] Appl. No.: 281,620

[22] Filed: Jul. 28, 1994

[30] Foreign Application Priority Data

Feb. 24, 1994 [CA] Canada ..... 2116395

[51] Int. Cl.[6] ..... E05D 15/22

[52] U.S. Cl. ..... 49/162; 49/158; 49/159; 49/260; 160/243

[58] Field of Search ..... 49/158, 159, 160, 49/162, 155, 177, 176, 178, 187, 260; 160/243

[56] References Cited

U.S. PATENT DOCUMENTS

| | | | |
|---|---|---|---|
| 1,341,366 | 5/1920 | Fournier . | |
| 1,600,796 | 9/1926 | Campbell . | |
| 4,571,885 | 2/1986 | Uemura et al. | 49/177 |
| 5,058,321 | 10/1991 | Harbom et al. | 49/177 |
| 5,289,656 | 3/1994 | Vetter | 49/260 X |
| 5,414,960 | 5/1995 | O'Donnell et al. | 49/177 |

FOREIGN PATENT DOCUMENTS

| | | |
|---|---|---|
| 657436 | 9/1951 | United Kingdom . |

*Primary Examiner*—Anthony Knight
*Assistant Examiner*—Curtis A. Cohen
*Attorney, Agent, or Firm*—Neil H. Hughes; Ivor M. Hughes

[57] ABSTRACT

A pivoting and sliding closure assembly is provided which rides in a guide channel of a frame upon a pivot shoe assembly which at one end securely pivots a closure member upon one pivot shoe when the closure is pivoted away from the channel, and which latches the closure member in a slidable position when the closure member is pivoted to its latched position. The pivot shoes are connected together by a multiple segment shaft in the assembly and unique rack and pinion structure is incorporated in the assembly.

47 Claims, 16 Drawing Sheets

PARALLEL BALANCE SYSTEM

FIELD OF INVENTION

This invention relates to a mounting system for a closure member in an assembly which allows the secure sliding and subsequent pivoting of the closure member from a position parallel to the assembly, wherein sliding of the closure member is allowed, to a fully pivoted position. The invention is preferably embodied in a window assembly but finds application also in patio doors, and doors.

BACKGROUND OF THE INVENTION

Double hung windows are well known in the art. There are a multiplicity of examples of such double hung windows which incorporate window frames for the sliding of a window sash within a jamb guide. Further there are many examples within the prior art which allow for the sliding of a window sash within a frame within the jamb channels thereof which further incorporate a carrier or shoe attached to the window sash which allows for the pivoting of the window sash away from the window frame.

A multiplicity of designs for sliding patio doors further exist within the prior art. A typical patio door is made up of one stationary framed main glass panel and one moveable framed main glass panel sliding in a horizontal direction adjacent the stationary panel and which does not typically pivot. The weight of the patio door would require a substantial device in order to allow for the secured pivoting thereof. Such hardware would further eliminate or minimize the door sagging out of position and the need for realignment of the doors when pivoted back to the closed position. The pivoting of patio doors would be quite attractive and would allow for the marketing of large French type doors in the industry. No such doors exist within the market place at the present time.

Further within the prior art there is taught a tilt slider and the hardware therefore as taught in U.S. Pat. No 4,888,915 issued Dec. 26, 1989, U.S. Pat. No. 5,168,665 and co-pending application Ser. No. 07/677,135 filed Mar. 29, 1991 manufactured and distributed by Canadian Thermo Windows, whose office is in Toronto, Canada. The manufacture of tilt and slide windows, double hung windows, patio doors, and similar structures according to the teachings of the above mentioned three references obviated many of the prior art problems which will generally occur when any pivot block provided at the pivoting end of the window sash moves out of alignment in relation to the upper or lower pivot block adjacent the same lineal of the closure member. The only means for securing the sash of the window to the pivot block previously has been either a pin or strut. The continuing motion and sliding of the windows back and forth and the pivoting thereof causes the windows to misalign and sag under the weight of gravity especially when manufactured in a vertical tilt slider. U.S. Pat. No. 4,888,915 and the above mentioned other references overcame this problem by an improved bracing system of the closure in the closure assembly by interconnecting the shoes in a carrier assembly and including with some embodiments a braking mechanism to ensure the window cannot slide when pivoted or a locking mechanism to ensure that the window cannot pivot when sliding in a track. In this way parallelism of the pivots whether stationary or in motion was assured by the required locking of the closure member. Such an assembly although much improved over the prior art has the drawback of requiring the user to latch and unlatch a number of levers to operate the window in its various modes of operation. This is primarily necessary to ensure that the pivots stay substantially parallel at all times so that for example the window is locked while pivoting thereby ensuring parallelism, or that the window is locked in the track while sliding also ensuring through the interconnection of the shoes a constant spacing and hence substantially parallel running as well. It is therefore desirable to eliminate as much of the consumer interaction with the window assembly as possible and make the operation as simple and fool proof as possible.

Nowhere within the prior art is such a simplified improved device provided which allows for the manufacture of heavier windows and doors in larger sections without the sagging of the window and having reliable operating pivots incorporated in the assembly which both allows for the pivoting and sliding of the window by the user without the need for a multiplicity of user operated locks and latches.

Further in the manufacture of casement type windows there is found a large number of links and levers depending on the manufacturer of the window assembly. This renders the assembly costly to manufacture because of the assembly labour required. Further with protruding handles the window is prone to being damaged when shipped. One of the problems with known casement assemblies is that they are difficult to clean on the outside. U.S. Pat. No. 1,600,796 to Campbell addressed this concern. Further U.S. Pat. 1,341,366 endeavored to address this concern for casement windows. Final U.S. Pat. No. 5,289,656 attempted to improve on these previous structures. However the systems do not provide for ease of installation and variation in the window or door size which may be supported. Further the opening of the casement style windows provided to clean the outside of the window is insufficient to provide for all sizes of individuals and reaches.

It is therefore an object of this invention to overcome many of the deficiencies in the prior art stated above which allows for smooth and simple operation of a closure member which is capable of both sliding within a guide channel and tilting upon a pivot assembly thereof.

It is a further object of this invention to overcome many of the deficiencies in the prior art stated above which allows for smooth and simple operation and assembly of a casement style window which is capable of both pivoting to an open position, and allowing the pivoting end to slide within a guide channel to the opposite side of the frame within which the sash normally pivots for easy cleaning thereof.

It is a further object of the invention to provide a reliable carriage for use in relation to a guide channel disposed within a frame for a closure member whereby locking of the pivot when the closure member is rotated is unnecessary to maintain parallelism of the structure.

Further and other objects of this invention will become apparent to a man skilled in the art when considering the following summary of the invention and the more detailed description of the preferred embodiments illustrated herein.

SUMMARY OF THE INVENTION

According to one aspect of the invention, there is provided a closure assembly having two ends comprising a first and second track disposed proximate each end of the assembly respectively, and a slidable and pivotable closure member, the closure member including framing sections therefor and being engaged with the first and second tracks proximate first and second pivots adjacent the pivotable end of the member, the first and second pivots being interconnected by a multiple segment, shaft disposed within framing sections of said closure member, (for example the shaft including at least two portions and preferably being telescoping) the shaft providing for accurate installation, retention, removal, adjustment and alignment of the first and second pivots within the first and second tracks in a substantially parallel line with respect to one another and for pivotally supporting the closure member which may be safely and securely pivoted away from the closure assembly, whereby the first and second interconnected pivots are adapted to remain engaged with the first and second tracks while supporting the closure member both when it is pivoted away from the closure assembly and when it is slidable relative to the tracks.

In one embodiment the closure assembly may further comprise a carrier traveling within each of said first and second tracks and having interconnected first and second portions disposed within each of said first and second tracks, the first portion being engaged with the first and second pivots of the closure member and the second portion being spaced from the first portion within each of the first and second tracks the carrier to further assist sliding movement and pivoting movement of the closure member and preferably wherein the distance between said interconnected first and second portions is adjustable.

Preferably the first portion of the carrier traveling within each of said first and second tracks further comprises an opening within which the first or second pivots are disposed to cooperate with the first portion. Preferably the first and second pivots may further comprise a rotatable pinion disposed therewith for facilitating the movement of the carrier relative to each of the first and second tracks preferably in cooperation with a rack disposed with each of said first and second tracks. Preferably the closure member may further comprise latching means for latching the closure member in relation to the carrier to prevent pivoting of the closure member when the closure member is slidable relative to the tracks, and preferably wherein the latching means is a central locking member disposed with the framing sections of the closure member.

According to another aspect of the invention, there is provided a pivoting and sliding closure assembly comprising:

i) an opening extending within a frame ii) the frame having two ends and having disposed therein or attached thereto proximate each end track portions extending in a substantially parallel direction to the extensions of said ends of said frame;

iii) at least one closure member having framing portions and two ends and being slidable within said track portions and pivotable proximate at least one end thereof and latchable in the track portions proximate the other end thereof;

iv) each of said track portions having disposed therein at least two pivot shoes adjacent the pivoting end of the closure member, each shoe being substantially compatibly shaped with the track portions and having a top and bottom, (preferably having rolling means disposed adjacent the bottom thereof for assisting the movement of the pivot shoe), each shoe having disposed therein adjacent the pivoting end of the at least one closure member an opening extending from the top toward the bottom of the shoe wherein pivot means are disposed, said pivot means provided with said pivot shoes being interconnected by a multiple segment shaft disposed within said framing portions of said least one closure member, (for example the shaft including at least two portions and preferably being telescoping), the shaft providing for accurate installation, retention, removal, adjustment and alignment of the first and second pivots within the track portions in a substantially parallel line for pivotally supporting the at least one closure member for safe and secure pivoting away from the closure assembly;

v) the at least one closure member having latching means provided therewith for latching the at least one closure member in relation to the track portions to prevent the at least one closure member from pivoting upon the pivot means when the at least one closure member remains slidable with said track portions; and preferably the latching means is central locking member disposed with the framing portions of the at least one closure member.

vi) the at least one closure member being braced by the multiple segment shaft interconnecting the pivot means disposed with each track portions, the substantially parallel alignment of the pivot means provided by the multiple segment shaft preventing the pivot means from misaligning and/or disengaging from the relevant track portions when the at least one closure member is rotated to an open position and/or when it remains slidable within said track. Preferably the pivot means may further comprise a rotatable pinion for facilitating the movement thereof relative to the track preferably in cooperation with a rack disposed with said track.

Preferably said closure member may further comprise a window sash being a casement, double hung, or tilt and slide installation or, a door or a patio door.

According to another aspect of the invention, there is provided a pivoting and sliding closure assembly comprising:

i) an opening extending within a peripheral frame said peripheral frame including a header portion, a sill portion and two vertically extending jamb portions;

ii) the sill and header portions or the two jamb portions having disposed therein or attached thereto track portions extending in a substantially parallel direction to the extensions of said peripheral frame portions;

iii) at least one closure member having two ends and framing portions and being slidable within said track portions and pivotable proximate at least one end thereof and latchable in the track portions proximate the other end thereof;

iv) each of the track portions having disposed therein adjacent the pivoting end of the at least one closure member at least two pivot shoes, each pivot shoe being substantially compatibly shaped with the track portions and having a top and bottom, (preferably having rolling means disposed therein proximate the bottom thereof for assisting the movement of the pivot shoe), each pivot shoe having disposed therein adjacent the pivoting end of the at least one closure member an opening extending from the top toward the bottom of the shoe wherein pivot means are disposed, said pivot means being interconnected by a multiple segment shaft disposed within the said framing portions of said at least one closure member (for example the shaft including at least two portions) and preferably being telescoping), the shaft providing for accurate installation, retention, removal, adjustment and alignment of the pivot means in a substantially parallel line for pivotally supporting the at least one closure member for safe and secure pivoting away from the at least one closure assembly;

v) the at least one closure member having latching means provided therewith for latching the at least one closure member in relation to the track portions to prevent the at least one closure member from pivoting upon its pivot means when the at least one closure member remains slidable with said track portions; and preferably wherein the latching means is central locking member disposed with the closure member.

vi) the at least one closure member being braced by the multiple segment shaft which provides for accurate installation, retention, removal, adjustment and alignment of the interconnected pivot means disposed with each track portion, the substantially parallel line of the pivot means provided by the multiple segment shaft preventing the at least one closure member from misaligning and/or disengaging from the relevant track portion when rotated to an open position or when the at least one closure member remains slidable within said portions. In one embodiment said at least one closure member is a window sash being a casement, double hung, or tilt and slide installation. In another embodiment said closure member is a door and preferably a patio door. Preferably the pivot means may further comprise a rotatable pinion for facilitating the movement of the at least one closure member relative to the track, preferably in the pinion cooperating with a rack disposed with said track portions.

According to yet another aspect of the invention there is provided for use in a pivoting and sliding closure assembly, a closure member slidable within a guiding channel and pivotable therefrom, the closure member having a substantially rectangular frame having a top and bottom, and having engaged at its top and bottom proximate one end of the closure member pivots for engaging a first and second shoe, and having disposed at the other end of the closure member proximate its top and bottom, user accessible means for engaging the guiding channel (preferably wherein said user accessible means is a central lock);

said shoes being slidable in said guiding channel and comprising a substantially rectangular body having a top and bottom (preferably made from thermoplastic material) and preferably having disposed proximate the bottom thereof at least one roller or wheel), said shoes having disposed therewith pivot means (preferably the pivot means may further comprise a rotatable pinion for facilitating the movement of the shoes relative to the track preferably in cooperation with a rack disposed with said track) the rotatable pinion for engagement with the shoes, said pivot means being interconnected by a multiple segment shaft disposed within said frame (for example at least two portions and preferably telescoping), which provides for accurate installation, retention, removal, adjustment and alignment of the pivot means with said track portions, each shoe having an opening for said pivot means, the opening extending from proximate the top towards the bottom of said shoe, whereby when the closure member pivots upon the pivot means away from the guide channel it is braced from misalignment by the multiple segment shaft and by the interconnected pivot means disposed with each channel, the substantially parallel line of the pivots being provided by the multiple segment shaft when the closure member is rotated to an open position or when it remains slidable within said track. In one embodiment said closure member is a window sash being a casement, double hung, or tilt and slide installation. In another embodiment said closure member is a door and preferably a patio door.

According to another aspect of the invention, there is provided a closure assembly comprising a track and a slidable and pivotable closure member, the closure member being engaged with the track proximate first and second pivots adjacent a pivotable end of the closure member, the first and second pivots being connected by a cable system connecting the upper and lower pivots to move in and be maintained in substantially parallel positions at all times to retain and align the first and second pivots in a substantially parallel line for pivotally supporting the closure member so that it may be safely and securely pivoted away from the closure assembly, whereby the first and second connected pivots are adapted to remain engaged with the track while supporting the closure member both when it is pivoted away from the closure assembly and when it is slidable relative to the track.

According to another aspect of the invention, there is provided hardware for a closure assembly having a track and a slidable and pivotable closure member having framing portions and, the closure member being engaged with the track proximate first and second pivots adjacent the pivotable end of the member, the hardware comprising the first and second pivots being interconnected by a multiple segment shaft disposed within the framing portions of said closure member in use, (for example at least two portions and preferably telescoping), the shaft providing for accurate installation, retention, removal, adjustment and alignment of the first and second pivots in a substantially parallel line for pivotally supporting the closure member so that it may be safely and securely pivoted away from the closure assembly, whereby the first and second interconnected pivots are adapted in use to remain engaged with the track while supporting the closure member both when it is pivoted away from the closure assembly and when it is slidable relative to the track.

According to another aspect of the invention, there is provided hardware for a closure assembly having a track and a slidable and pivotable closure member, the closure member being engaged with the track proximate first and second pivots adjacent the pivotable end of the member, the hardware comprising the first and second pivots being connected by a cable system connecting the upper and lower pivots to move in and be maintained in substantially parallel positions at all times to retain and align the first and second pivots in a substantially parallel line for pivotally supporting the closure member so that it may be safely and securely pivoted away from the closure assembly, whereby the first and second connected pivots are adapted to remain engaged with the track while supporting the closure member both when it is pivoted away from the closure assembly and when it is slidable relative to the track.

According to yet another aspect of the invention there is provided a resiliently biased lock and handle which normally locks the shaft of any of the aforementioned embodiments in operation until the handle is operated by a user wherein the lock unlocks the shaft and allows the shaft to rotate, and when the handle is released again said lock locks the shaft, allowing for continuous locking of the window at any position.

In an embodiment of the aforementioned invention in the preceding paragraphs when embodied in a tilt and slide or double hung window the inside rack portions provided within the track of the assembly, which extend the full width of the frame, curve towards the stationary closed position for the window assembly and provide a closed window assembly in which both sashes are oriented in a straight line.

In an embodiment of the aforementioned invention in the preceding paragraphs when embodied in a tilt and slide, casement or double hung window a retractable screen is provided disposed within the jamb of the assembly which accumulates on and pays out from a spring biased roll disposed within said jamb, the screen being retractable for egress or cleaning purposes, and available as desired by providing a detent on the opposite jamb engageable with the screen when in its operatable position.

In an embodiment of the aforementioned invention in the preceding paragraphs when embodied in a casement window a link having two ends is fastened at one end proximate the center of the bottom of the window sash and proximate the other end of the link adjacent the end of the sill of the window frame to allow for full operation of the casement window from a fully closed to a fully open position and the movement of the pivoting end of the window towards the opposite end so as to allow full access to the outside of the window and the easy cleaning thereof. In another embodiment the link is removable to allow total reversing of the window for cleaning and/or removal purposes.

In another embodiment of the invention the rack disposed with the track is made from aluminum and formed in three separate steps so as to minimize the amount of vertical creeping of the rack when formed. The rack also acts as a liner to distribute the load of the sash and minimize distortion of the preferred vinyl extrusions.

Figure 1:
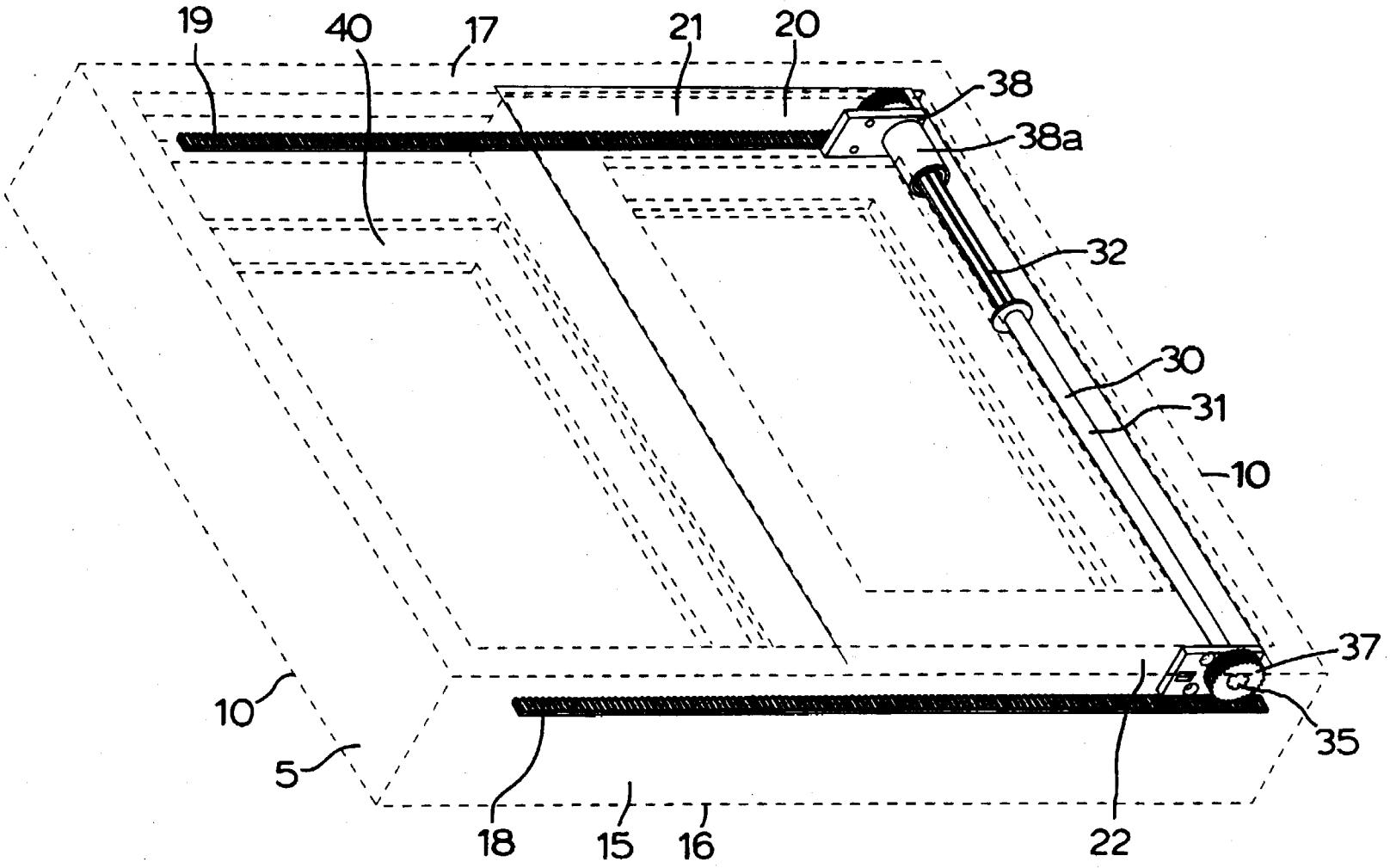
FIG. 1 is a schematic perspective view of a tilt and slide window, wherein said windows move in a horizontal direction, illustrated in a preferred embodiment of the invention.

FIG. **2*a* is a top view of the window of FIG. 1**.

FIG. **2*b* is a end view of the window of FIG. 1**.

Figure 3:
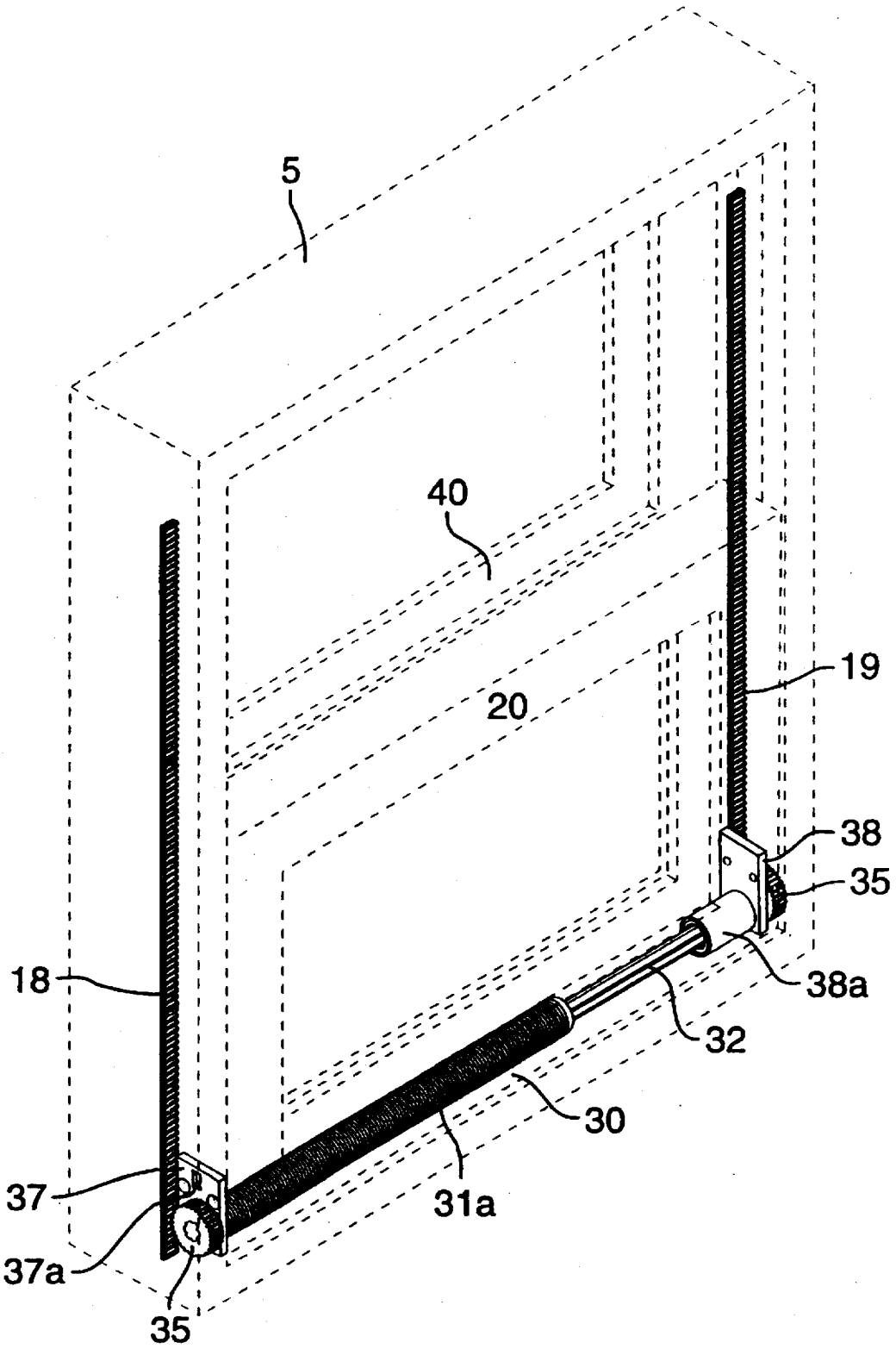

FIG. 3 is a double hung window assembly utilizing hardware similar to that of FIG. 1 and illustrated in a preferred embodiment of the invention.

Figure 4:
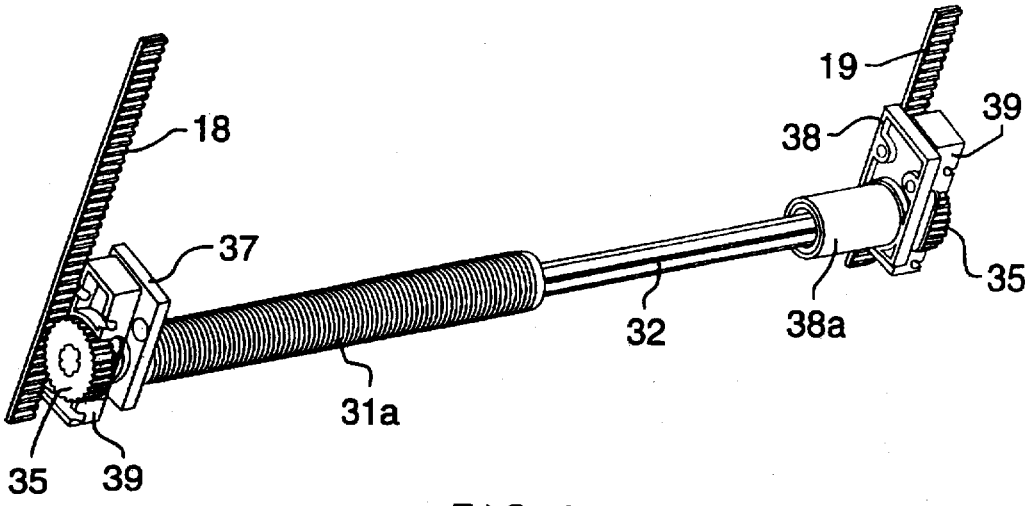

FIG. 4 is a perspective illustration of the hardware only for the double hung window of FIG. 3.

Figure 5:
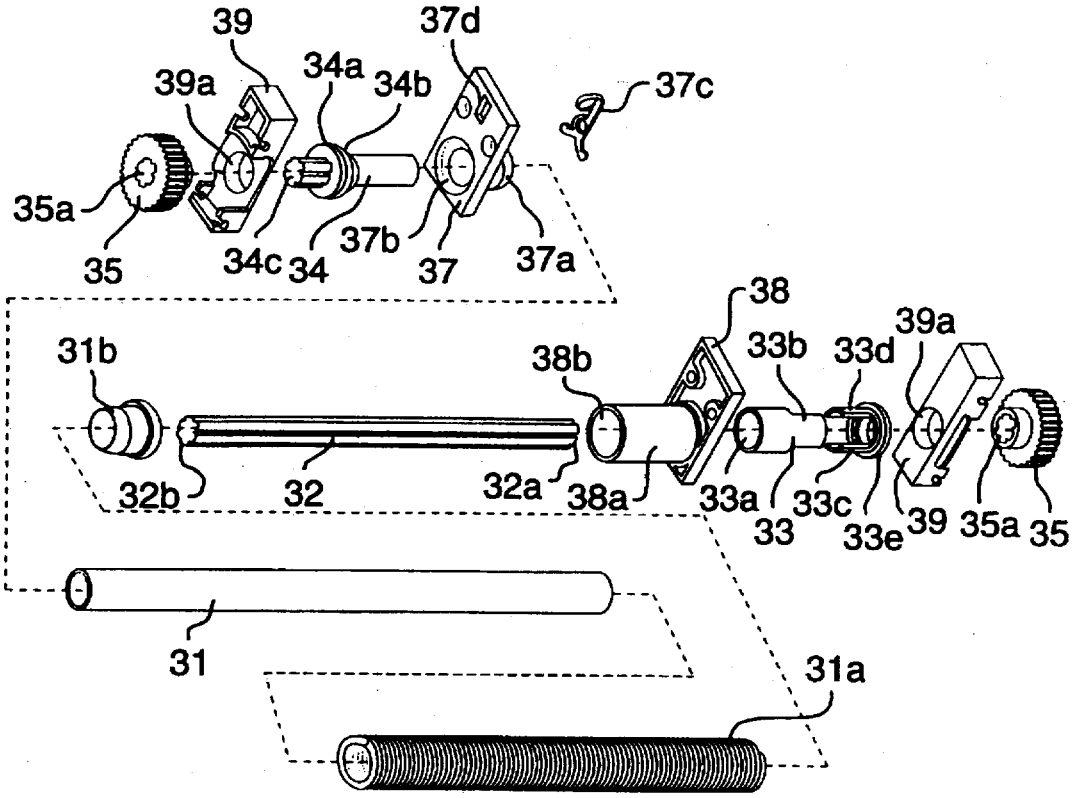

FIG. 5 is an exploded perspective view of the components of the hardware of FIG. 4 to be installed in a double hung window assembly.

Figure 6:
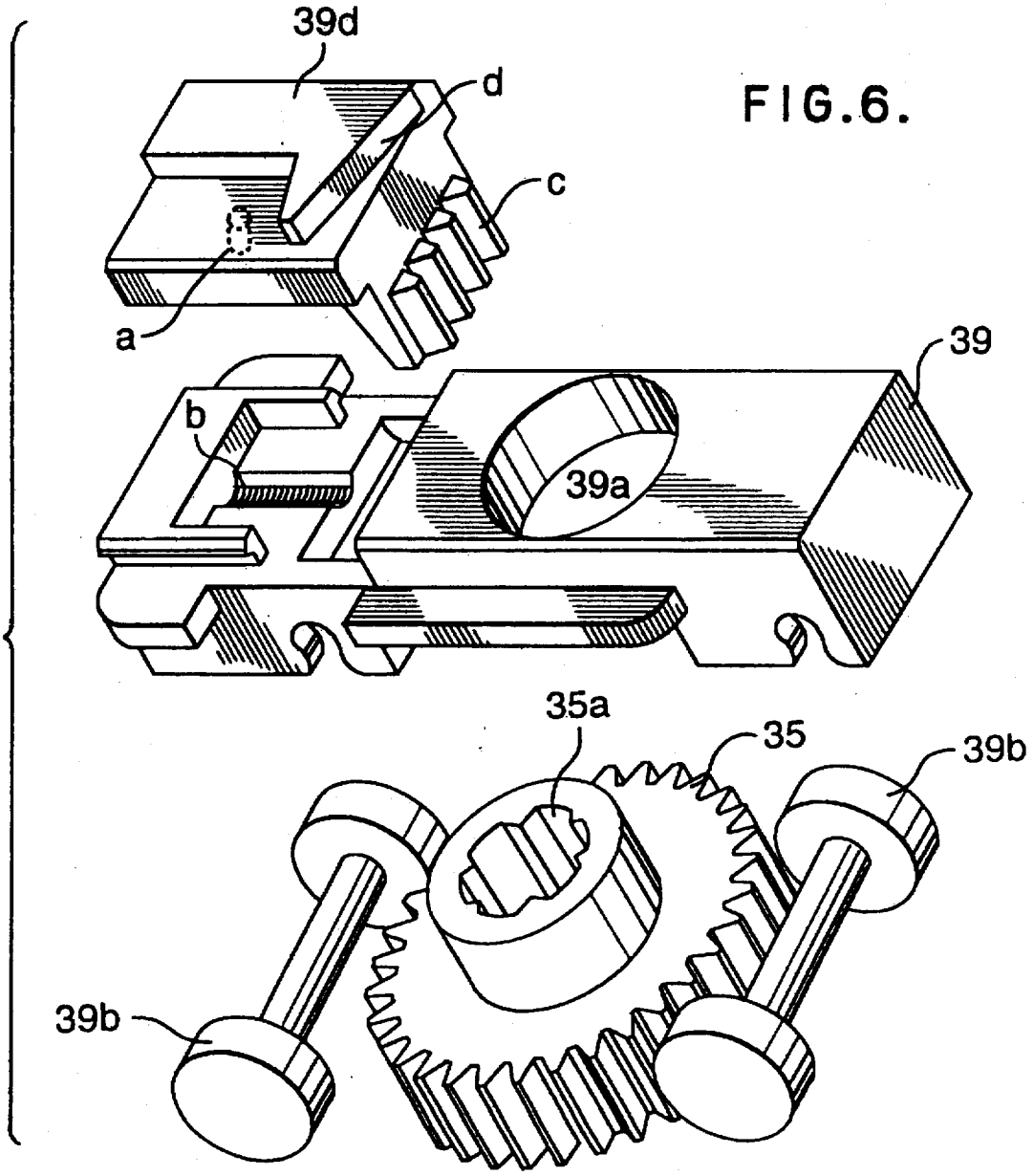

FIG. 6 is a carrier design illustrated in a preferred embodiment of the invention which allows for ease of removal of a window from a window assembly and illustrated in an exploded perspective view.

Figure 7:
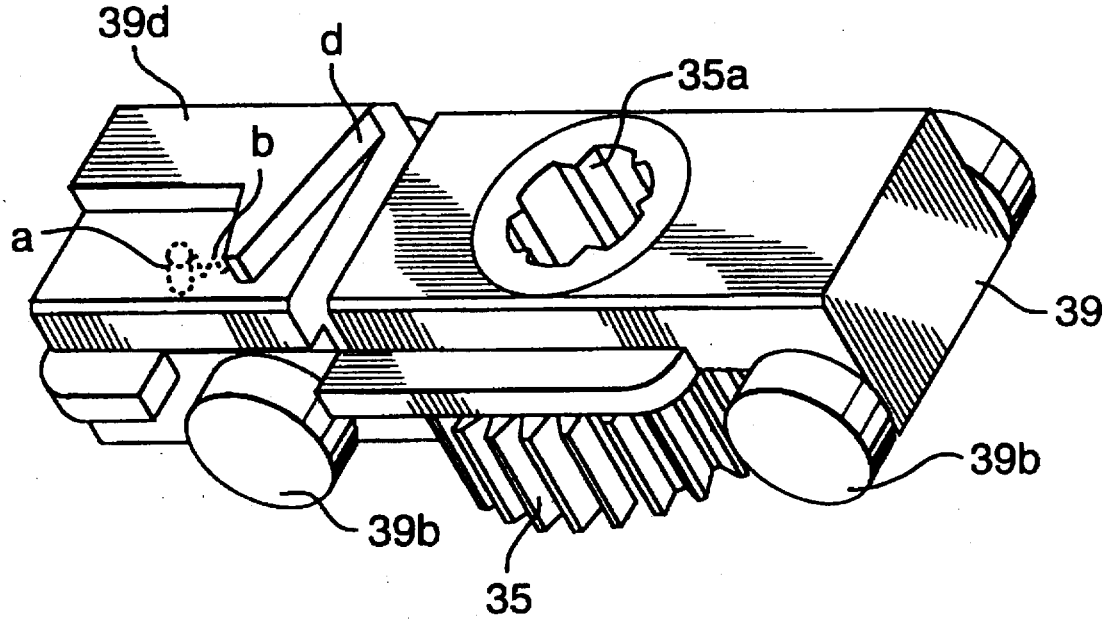

FIG. 7 is an assembled view of the components of FIG. 6.

Figure 8:
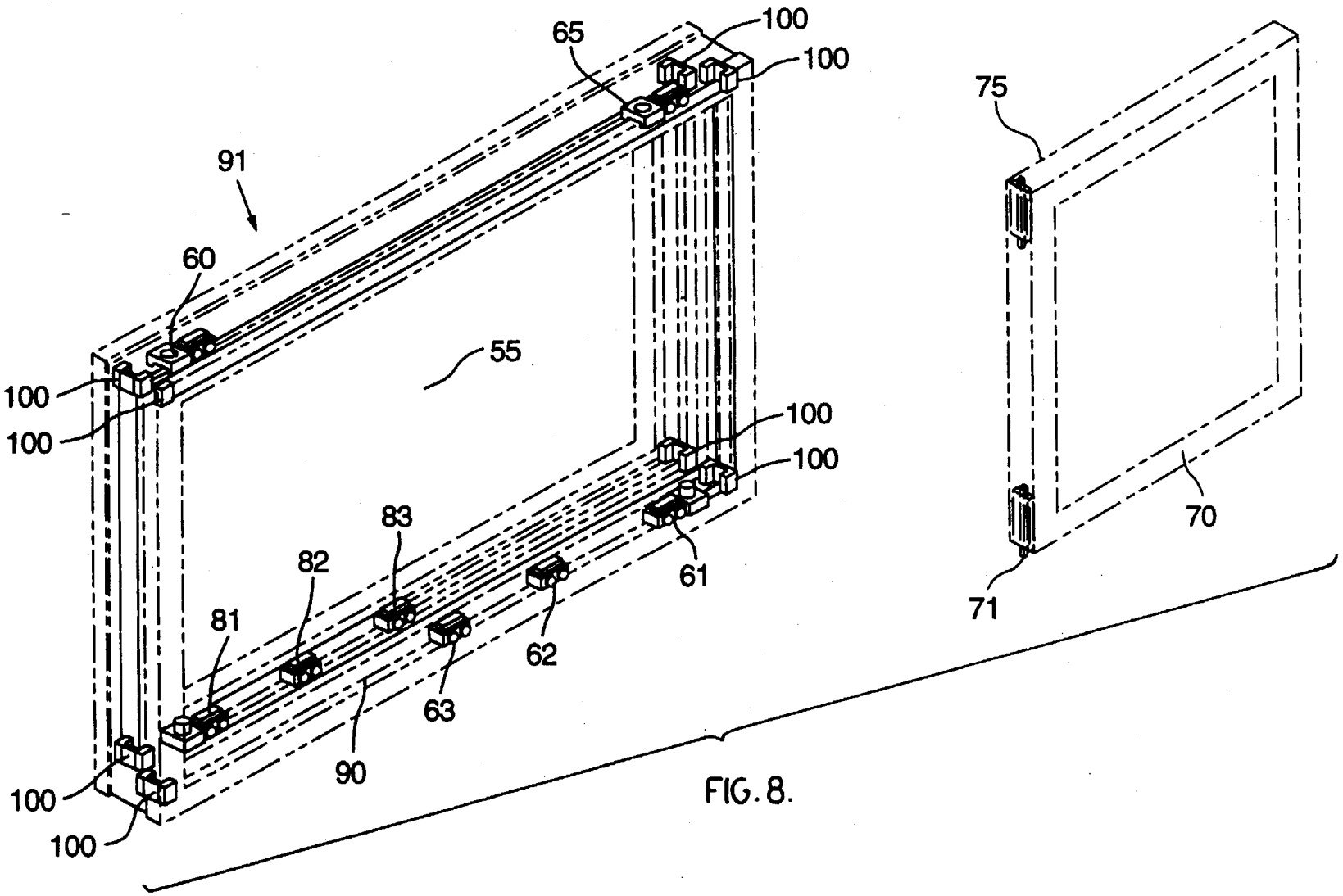

FIG. 8 is a schematic view of a tilt and slide window assembly illustrated to emphasize primarily the hardware therefor and illustrated in an alternative embodiment of the invention.

Figure 9:
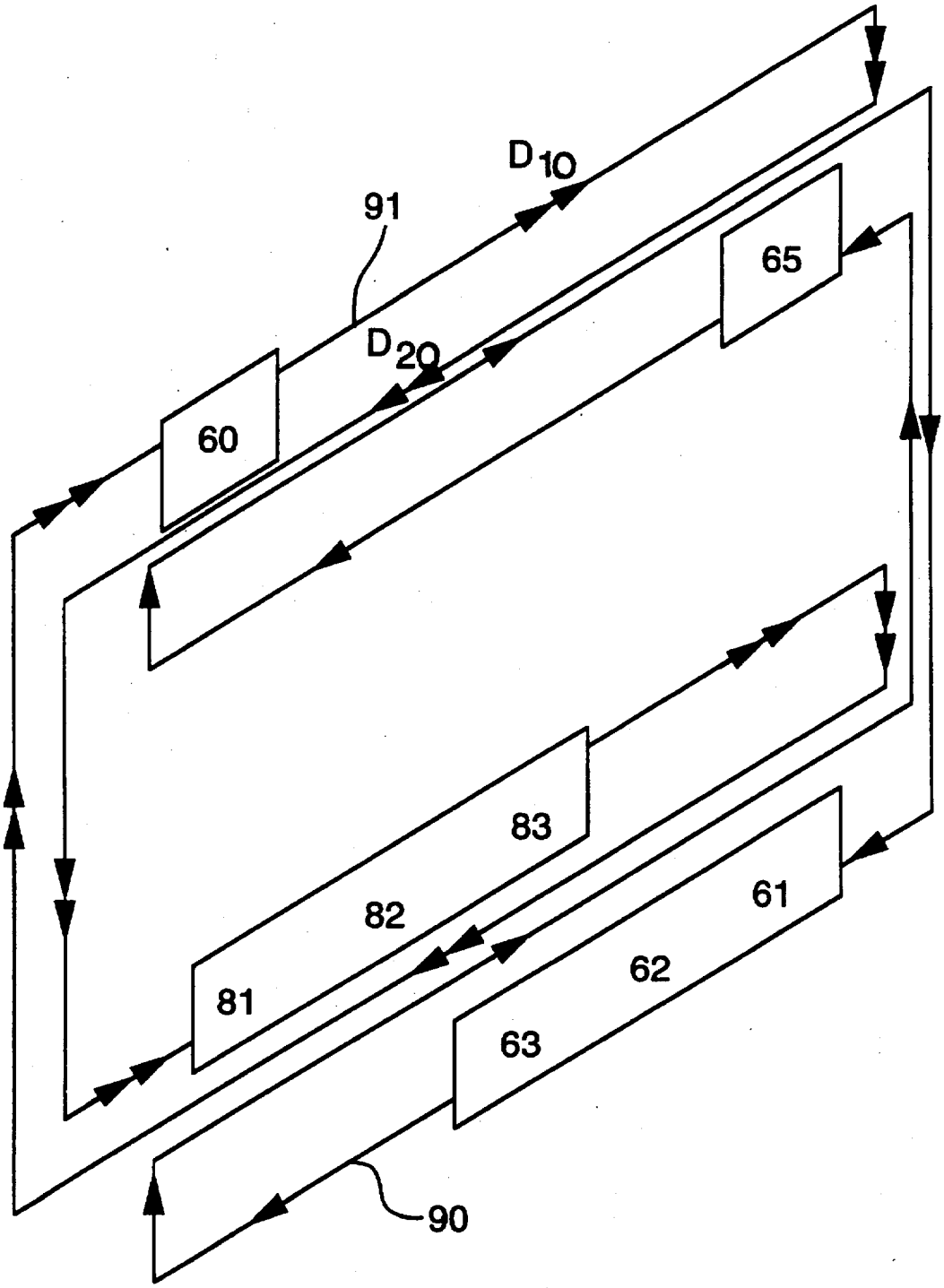

FIG. 9 is a schematic view of the movement of the shoes of FIG. 8 illustrated in alternative embodiment of the invention.

Figure 10:
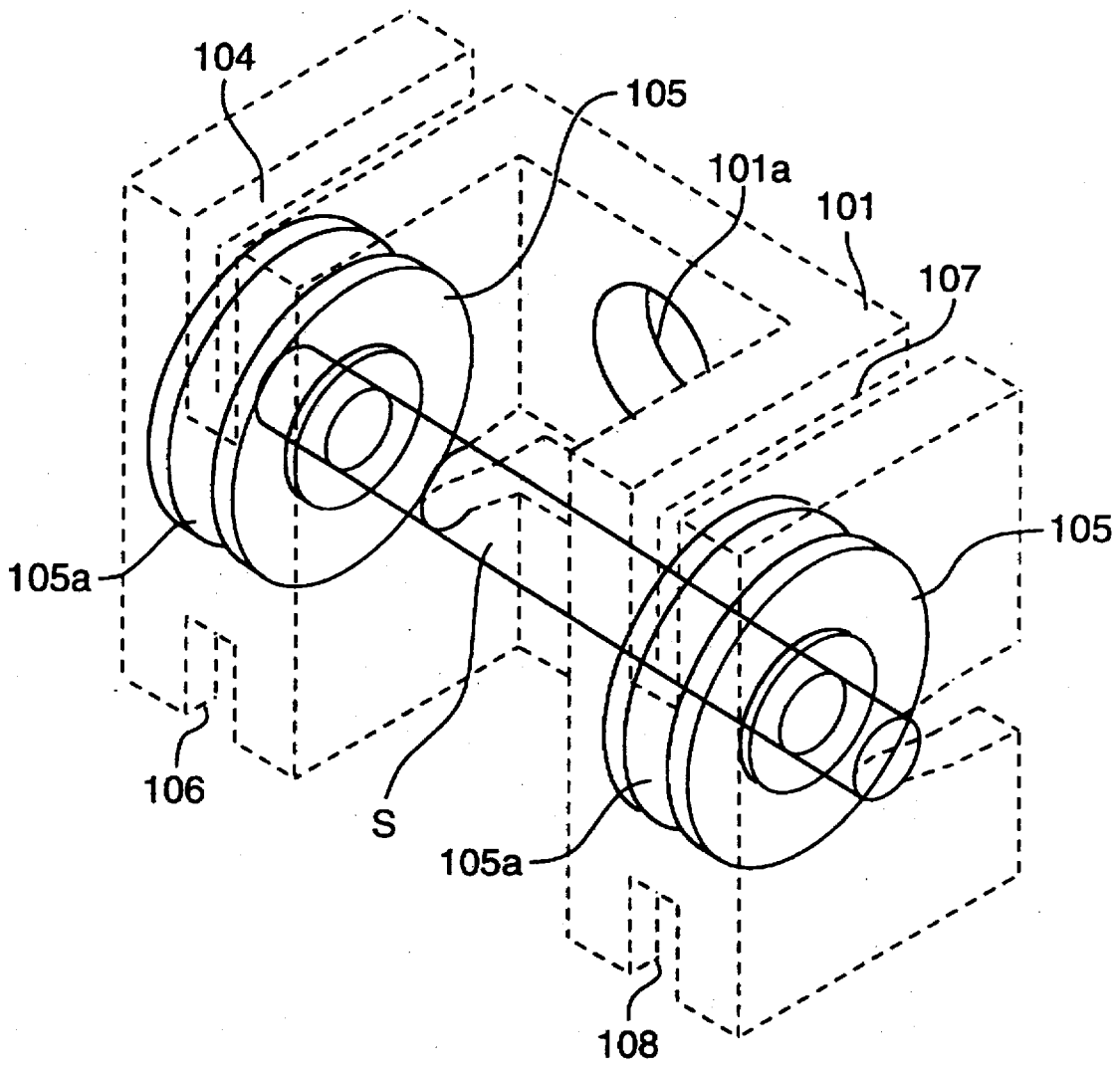

FIG. 10 is a perspective illustration of a pulley arrangement installed at the corners of the window assembly of FIG. 8 and illustrated in alternative embodiment of the invention.

Figure 11:
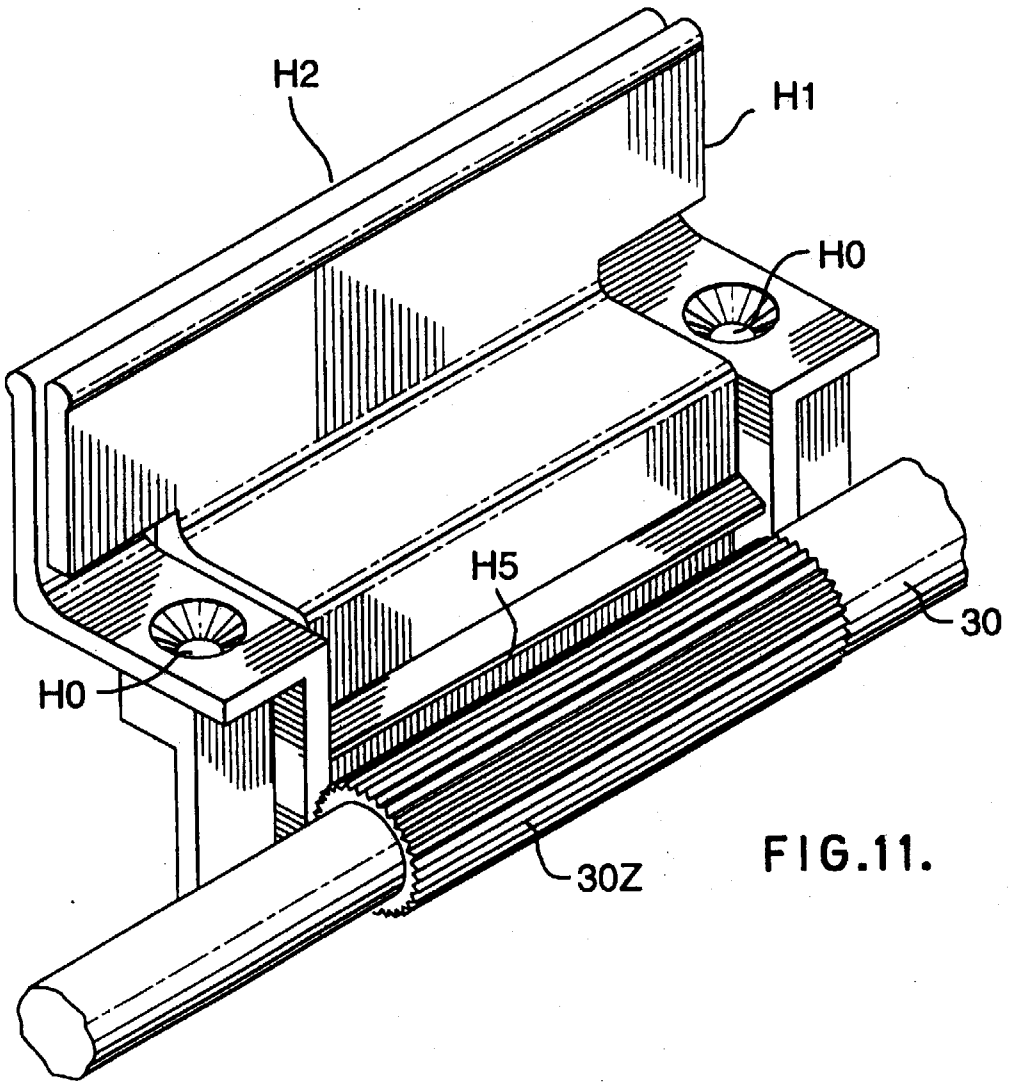

FIG. 11 is a close-up perspective view of a locking mechanism for the shaft assembly 30 shown for example in FIG. 1 and illustrated in a preferred embodiment of the invention.

Figure 12:
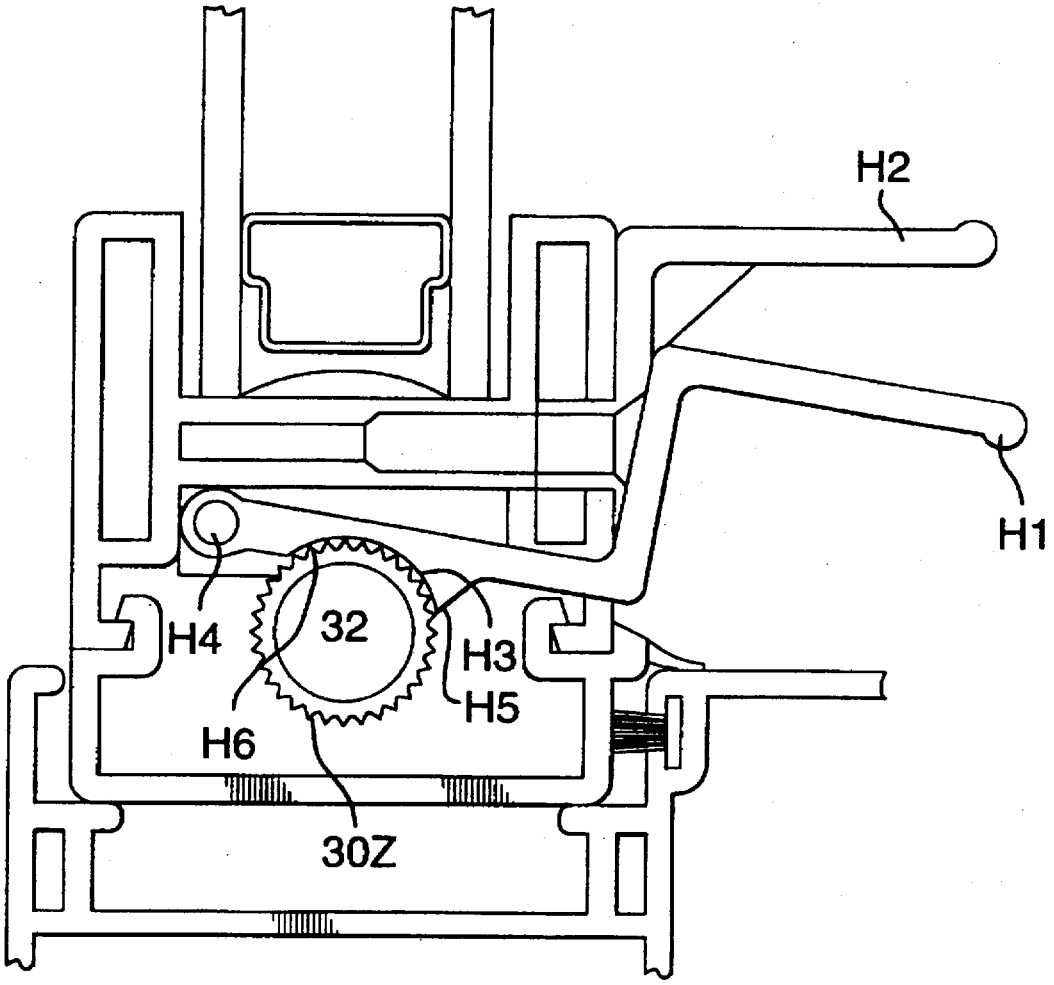

FIG. 12 is an end view of the locking mechanism of FIG. 11 illustrated in a preferred embodiment of the invention.

DETAILED DESCRIPTION OF THE PREFERRED EMBODIMENTS

Figure 2:
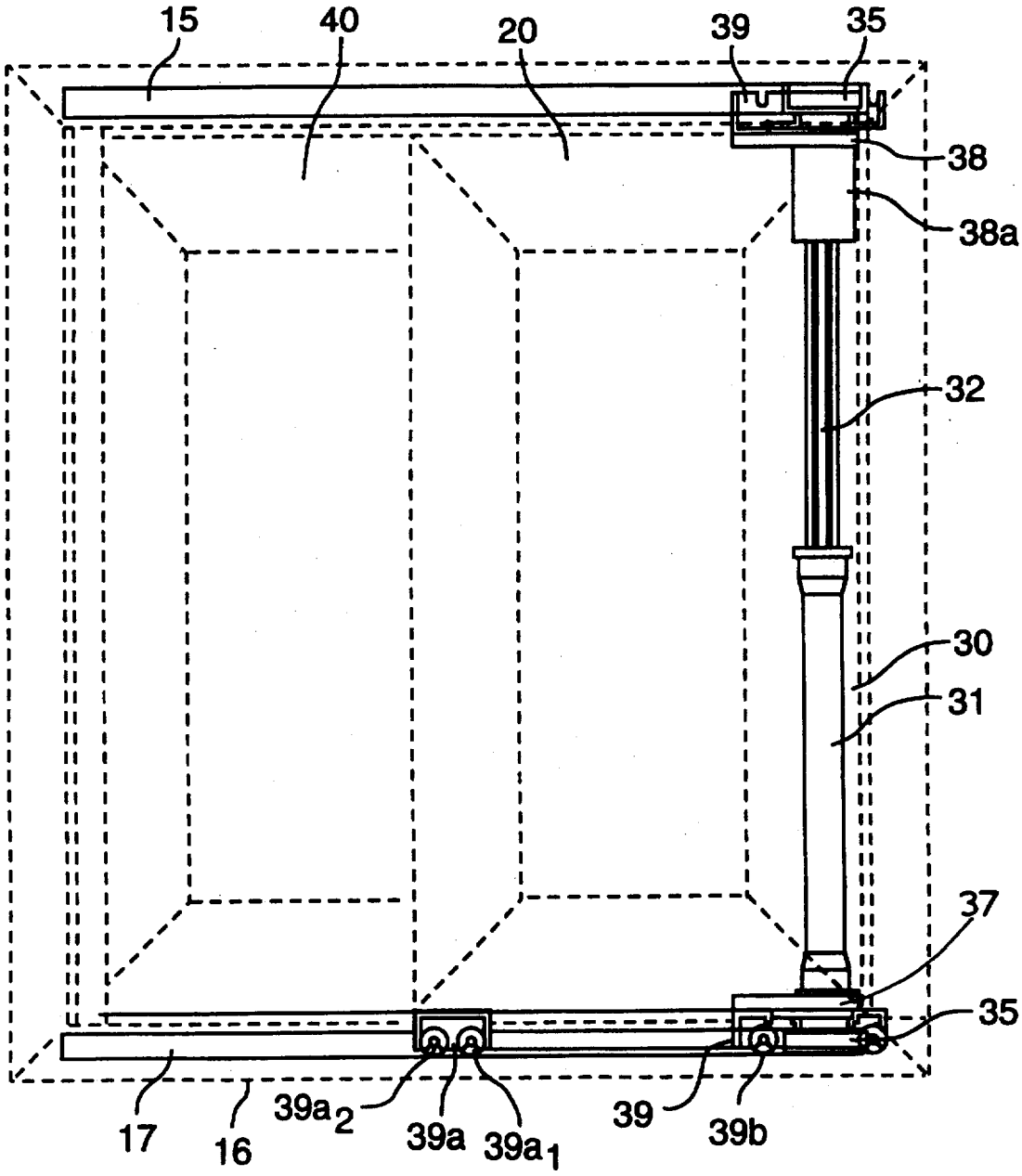
FIG. 2 is a front view of the window of FIG. 1.

Referring now to FIGS. 1 and 2 through **2*b* there is illustrated a tilt and slide window assembly. The assembly 5 includes an outer frame portion 10 which is normally hung within an opening established in a building (not shown). Normally nailing flanges are provided for this purpose in order to attach the assembly to the outer frame 10. The frame 10 includes top portions 17 and bottom portions 16 having tracks disposed therein, as best seen in relation to FIG. 2. Within the tracks are contained a pivot assembly which will be hereinafter described. Primarily the pivot assembly includes a pinion 35 and carriers 38 and 37 interconnected by interconnecting portions 32 and 31 making up an interconnecting member 30. The pinions move as the window 20 is slid in the track portion by the movement of the pinion 35 with respect to the rack 18 or 19 respectively. In this way the pinions 35, being interconnected, remain parallel at all times in their motion along the track within which the rack 19 or 18** is disposed. The hardware is shown in normal view while the window assembly is shown in dotted lines, to emphasize the essence of the invention embodied with the assembly.

Figure 2A:
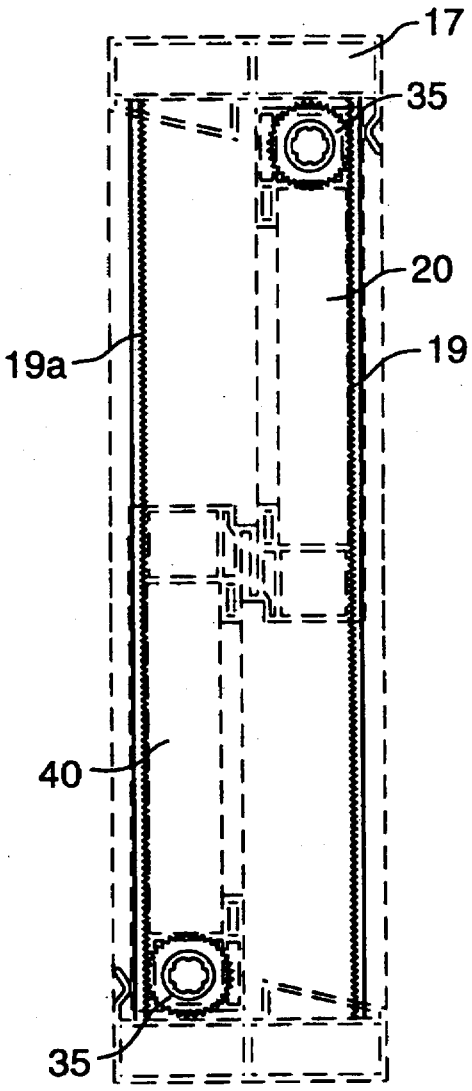

Referring now to FIG. 2 there is illustrated the window of FIG. 1, wherein windows 20 and 40 are slidable within a track 15 and 17 upon a shoe 39. The lower shoe 39 also is connected to a secondary shoe **39*a* for carrying the window which includes rollers 39*b*, 39*a*1 and 39*b*2 on the bottoms thereof respectively for ease of movement within track 17. The pinion 35 rests within the shoe 39 as will be described hereinafter. The arrangement of the interconnecting portion 30 will also be described hereinafter. Window 40 therefore has its own interconnected system as can be best seen in relation to FIGS. 2*a* and 2*b***.

Figure 2B:
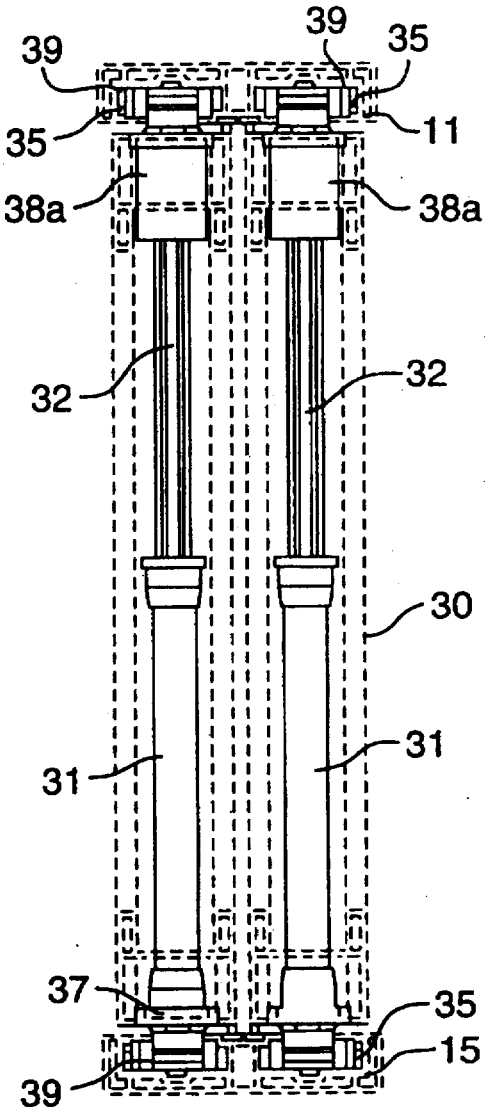

Referring now to FIG. **2*a* there is illustrated the sash elements 20 and 40 and the rack portions 19 and 19*a* which accommodate the motion of the pinion 35 along the full length of the track, as best in FIG. 2*b***.

Referring to FIGS. 1 and 2 to **2*b* clearly the track portions 17 and 15 cooperate with the rack portions 19 and 19*a* to provide for engagement with the pinion 35 and its motion when the window remains slidable within the track. By interconnecting the two pinion portions and hence the two pivot shoes, by interconnecting means 30**, the shoes remain in a substantially parallel position in relation to one another at all times. This overcomes the problem described in the background of the prior art. By the shoes remaining substantialy parallel at all times it is almost impossible for the window to come out of the track when the window is pivoted to be cleaned, and therefore it is no longer necessary to provide braking portions as in previously described inventions of Canadian Thermo Windows, as referred to in the background of the invention.

Figure 1A:
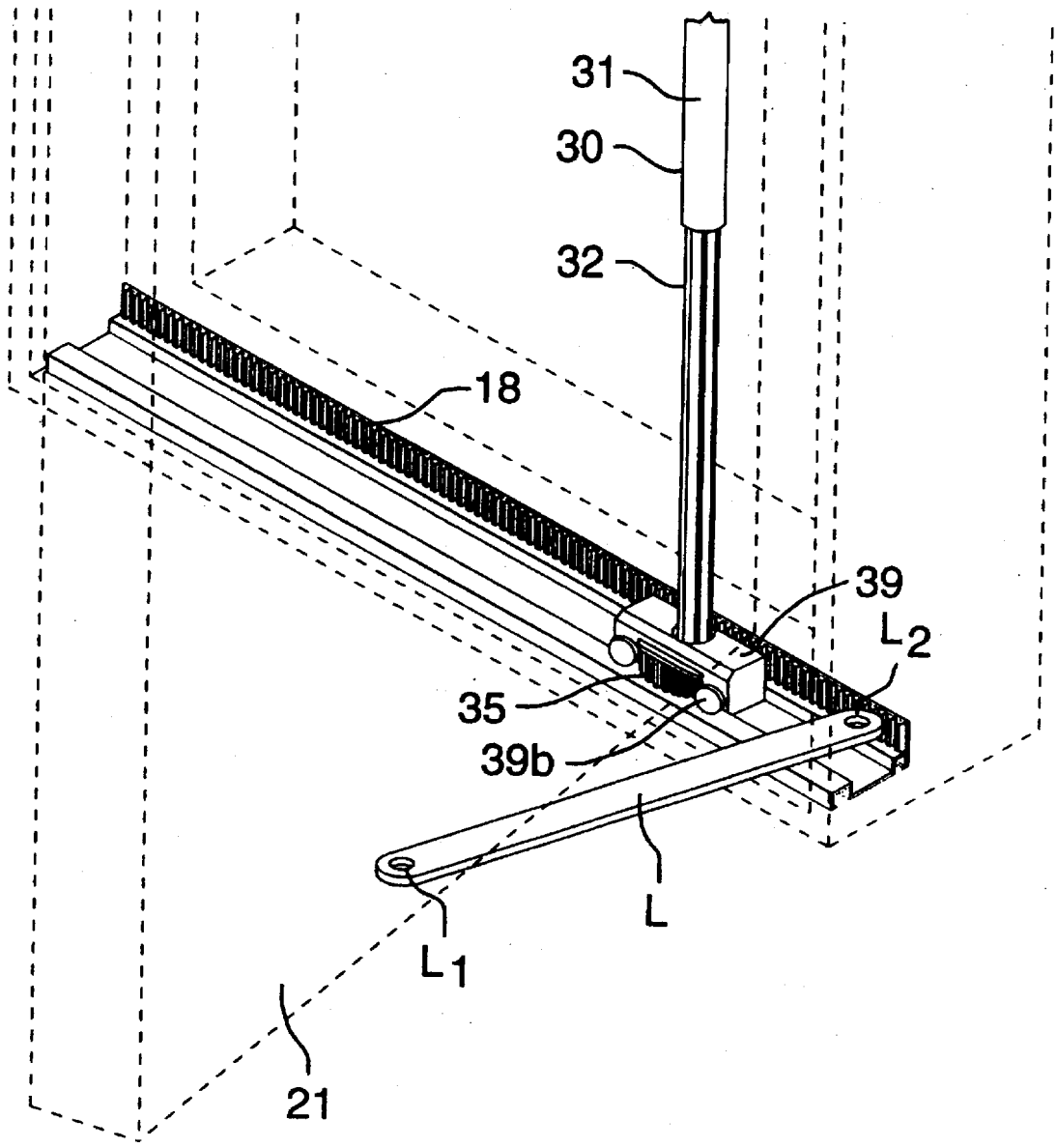
FIGS. 1A and 1B are partial schematic perspective views of casement style windows embodying the invention and depicting the motion thereof and illustrated in a preferred embodiment of the invention.
Figure 1B:
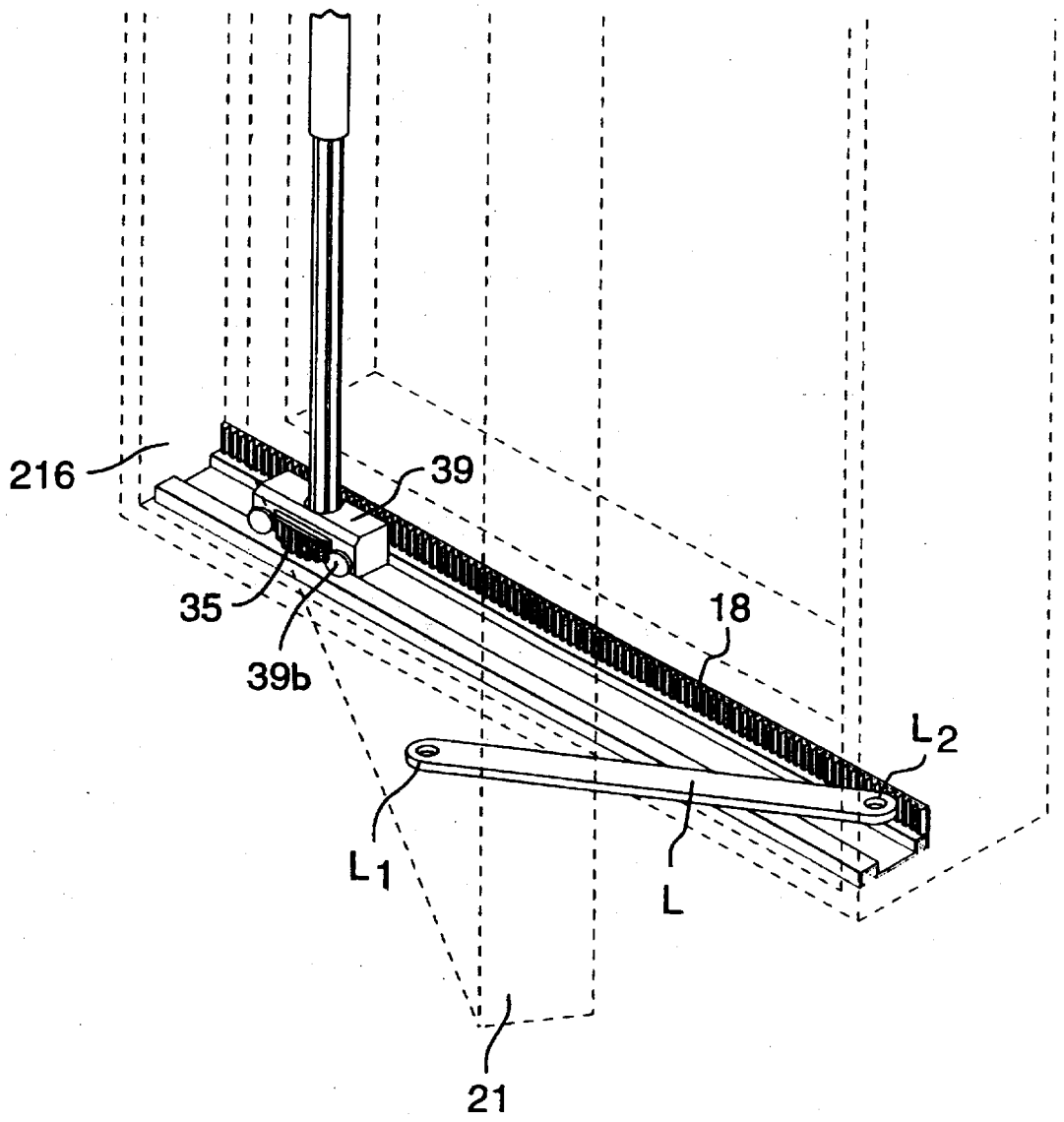

Referring to FIGS. 1A and 1B there is illustrated a casement style window having similar components to that found in relation to FIG. 1 with the exception that only one sash is provided which is fastened on shaft assembly 30 including portions 31 and 32. A link L is provided secured proximate ends L1 adjacent the center of the sash 21 proximate the bottom thereof and adjacent the track 18 adjacent the opening end of the window sash 21. By positioning the sash in this manner a full range of pivoting motion is available. If the link end L1 is removable from the sash, then the window sash may be moved totally to the opposite end remote the pivoting end 21*b* on shoe 39. As with the case of the tilt and slide window a shoe 39 containing a pinion is provided. The pinion is connected to the shaft 30 and engages the rack 18 as it moves along the window sill and header in parallel arrangement between the upper and lower pivots maintained in parallel by the shaft 30. In this manner the casement style window may be pivoted as normal to an open position, and the pivoting end may be moved to the other end of the window frame away from side 21*b* to allow ease of cleaning. By supplying the hardware described without a casement sash, the casement window may be assembled without the need for expensive pivots and linkages and without a great deal of assembly labour. As best seen in FIG. 1D for the casement style window in particular a rollaway screen S may be provided which is housed in the jamb channel as illustrated. The screen S pulls across to engage detent D1 with detent D2 in the opposite jamb channel, whereat it may be locked. This allows a user to clean the glass of sash 21 on the inside without the need to remove the screen as in prior art casement structure.

Figure 1C:
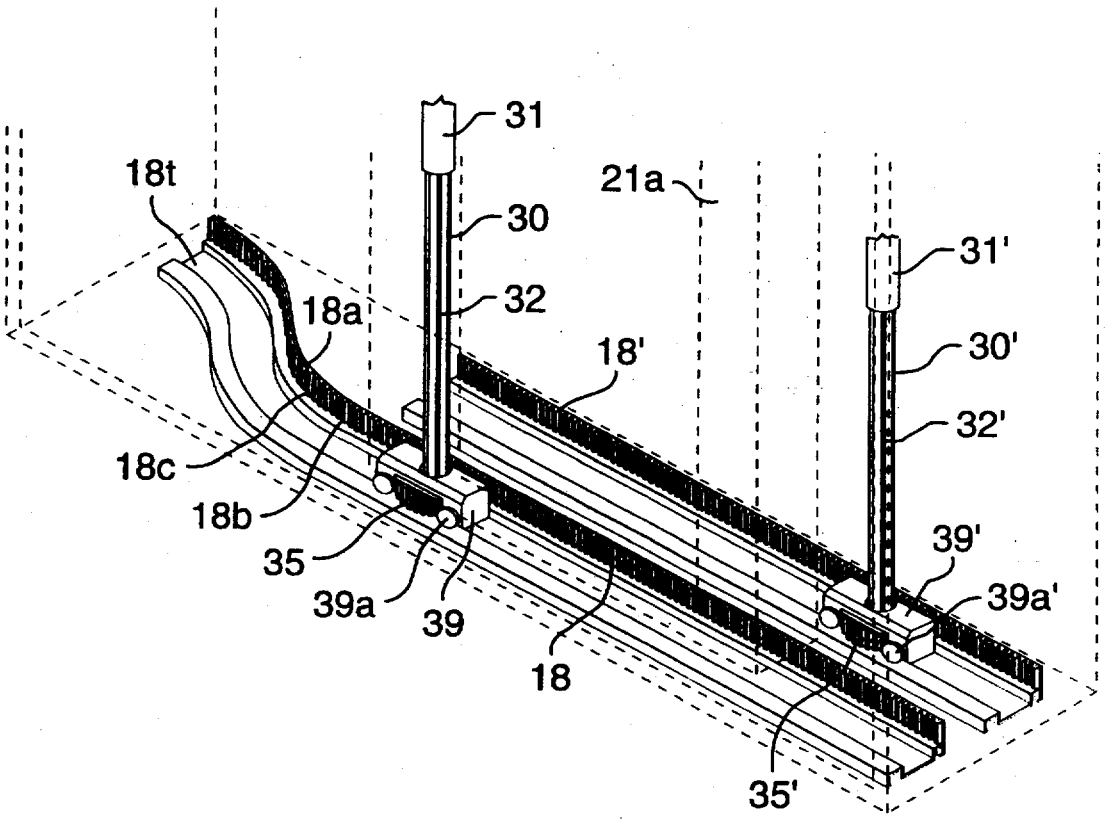
FIG. 1C is a partial schematic perspective view of straight line windows embodying the invention and depicting the motion thereof and illustrated in a preferred embodiment of the invention.
Figure 1D:
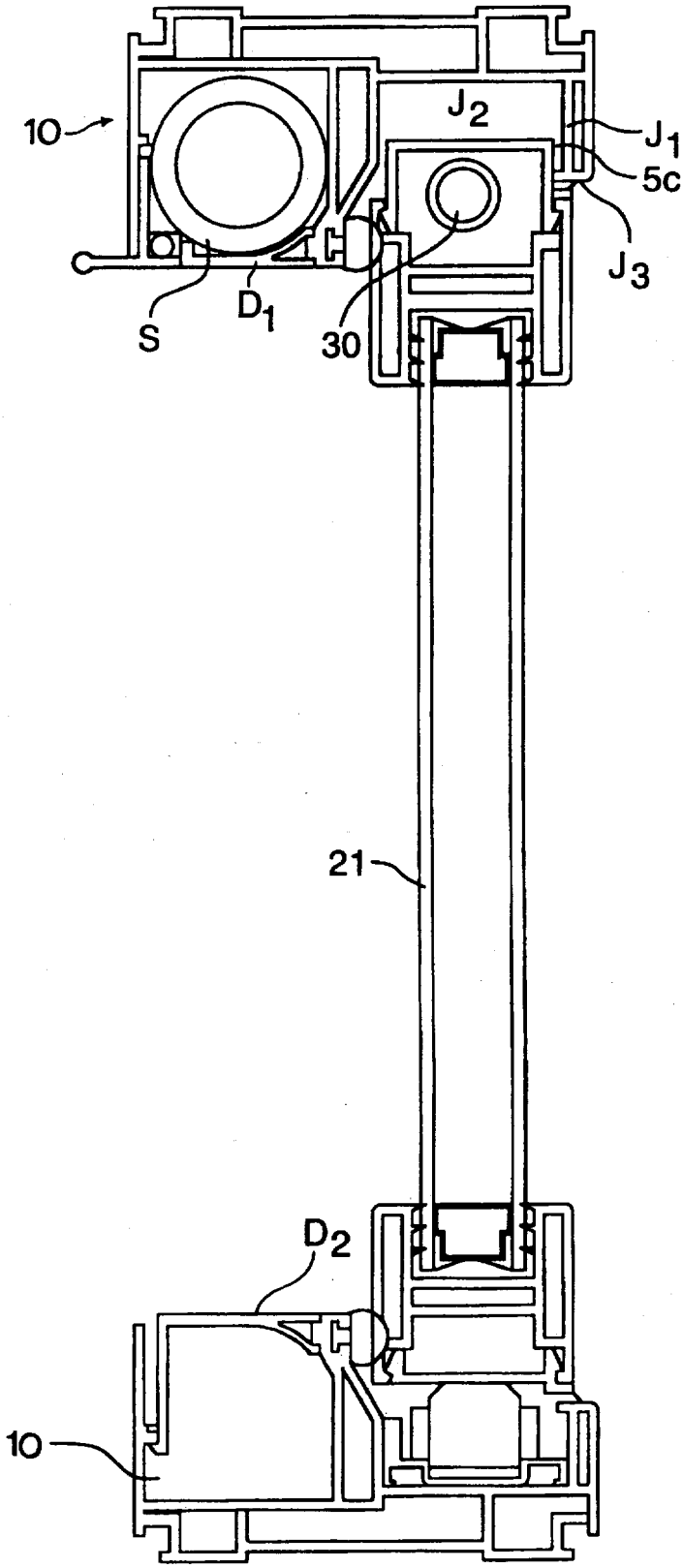
FIG. 1D is a partial cutaway view of the casement style windows of FIG. 1A depicting a rollaway screen thereof and illustrated in a preferred embodiment of the invention.

Referring to FIG. 1C there is illustrated a tilt and slide type window similar to FIG. 1 with the exception that when closed the window sashes will be oriented in a straight parallel line with one another. In order for this to happen the rack 18 provided includes a portion 18*a* made from fiber filled plastic or the like and joined at seam 18*c* to an aluminum track 18*b*. The sash 21 is therefore moveable as previously described on carrier 39 and rollers 39*a* as urged by pinion 35 until the pinion reaches the curved portion of the track 18*a* wherein the assembly 30 will move along the curved portions of the track to the terminus of the track 18*t*. The sash portion 21*a* will then butt in behind the edge of the sash contained in track 18' and be lockable at that position. The sash 21'(not shown) resides on assembly 30' in track 18'. As pinion 35' moves within the limits of rack 18' the sash 21 cannot adopt a parallel position unless sash 21' is in its fully closed position. Only then can the end 21*a* of the adjacent sash adopt its fully closed position butting up against the sash 21' at the end opposite the carrier assembly 30' and 39'.

Referring to FIG. 3 there is illustrated a double hung window assembly embodying a preferred embodiment of the hardware making up the invention substantially equal to that which is disclosed in FIG. 1, with the exception that a coil spring 31*a* is provided around the connector portion 31 of the interconnecting portion 30. By providing the interconnecting portion 31 with a spring 31*a* it will no longer be necessary in a double hung window assembly to provide a sash balance, as the spring 31*a* is pre-loaded to provide the necessary tension, much the same as a spring which is used in a garage door. In this example as a garage door goes up and down the spring is compressed and tensioned depending on the motion of the door and therefore provides for the return motion of the door. Within the window assembly sashes 20 and 40 shown in ghost line are moveable in a manner similar to the garage door example with hardware substantially made up of a pivot or pinion 35 moving on a rack 18 and 19 respectively and being interconnected by the interconnecting portion 30. The spring mechanism 31*a* provides an assist to the user, as in the case of the example, when the window sash is opened.

Referring to FIGS. 4 and 5 there is illustrated the hardware which is installed within the double hung window assembly of FIG. 3. Pinions 35 therefore are provided, which seat within the carriers or shoes 39. The pinion includes a shaped opening 35*a* which is compatible in shape with the bar stock 34*c* and 32*a* proximate the ends thereof. The pinion therefore will ride on the rack 18 and 19 within shoe 39. Opposed supplementary portion 37 is provided to oppose the shoe 39 in the jamb as it rides in the track. Therefore, referring to FIG. 2*b* the portion 37 and 38 may be readily seen. A combined ratchet and pawl assembly is provided with portion 37 or at least connected therewith. The pawl assembly 37*c* is resilient biased through the opening 37*d* of member 37 so as to release the ratchet 34*b* of shaft 34 when the window is to be removed from the assembly. Proximate the other end of the hardware there is provided a backing member 38 in a unique shaft extension 33 which includes portions 33*b*, 33*d*, 33*c* and 33*a* wherein the shaft end 32*a* extends through. A locking nut 33*e* is provided to lock the entire hardware together and to allow for ease of separation thereof. An adjustable connector 31*b* is provided proximate the other end of member 32*b* which allows for adjustment with regard to the length of section 32 of the shaft so as to allow variation in the sizes of the assembly supported. Portions 31, 31*b*, 32, and 33 makeup the shaft assembly which allows for ease of installation, adjustment, alignment and removal of the sash assembly. Also the hardware described provides for the interconnection of the pivot shoes proximate their sides and provides for parallel motion of the pivot shoes at all times thereby eliminating the need to lock the pivot shoes in the track assembly.

Referring to FIGS. 6 and 7 there is illustrated an alternative shoe construction which is useful when a window is removed, since the shoe will be locked in position when the window is removed for maintenance or for cleaning. Therefore the shoe 39 includes a spring b and a recess therefor and a supplementary portion 39*d* and a finger d therefor. Teeth c are provided on supplementary portion 39*d* which are biased by spring b against the pinion 35 to thereby lock against pinion 35 and prevent the motion of the carrier when the window is removed. A sloped wall d is provided with the carrier supplementary portion 39*d*, which when the shaft is removed or reinstalled releases the supplementary portion away from the pinion or toward the pinion. Therefore when the supplementary portion d is engaged it will drive the supplementary portion 39*d* away from the pinion 35 thereby allowing free motion of the pinion in normal circumstances. However when the shaft is disengaged the portion 39*d* will be free to move as biased by the spring b toward locking the pinion 35 via the teeth c of the supplementary portion 39*d*. The alternate shoe of FIGS. 6 and 7 has an opening 35*a* within which the shaft extension 32*a* or 34*c* passes to interconnect with the shoe 39 as previously described. The rollers 39*b* engage with the notches as shown to improve the motion of the carrier in the track.

Referring now to FIGS. 8, 9 and 10 there is illustrated an alternative embodiment of the invention to maintain the carrier pivots 61, 65, 60 and 81 in substantially parallel alignment and thereby eliminate the need for braking mechanisms. FIG. 8 is illustrated as a tilt and slide frame in ghost line with the window 70 also shown in ghost line having pivot 75 and 71. The pivots 75 and 71 engage with openings within the shoe 61 and 65 in the manner which is known. These pivot pins 75 and 71 may be removed from these shoes merely by retracting them from their locked positions. The sash 70 therefore is moved on the carrier 81, 82 and 83 proximate the bottom thereof in the track portions as shown and within carrier 60 on the top thereof. A similar sash arrangement would be arranged for the other shoes as well but for simplicity sake this is not illustrated. The important aspect is that a cable 91 is connected to the carrier 60 and the carrier assembly 81, 82 and 83 substantially as shown in FIG. 9, so that when the window moves toward the right hand side of the drawing, both carriers will move an equal amount by the movement of the cable, maintaining the pivots 75 and 71 within the shoes 60 and 81 substantially parallel at all times. Similarly, a cable 90 is provided which moves in conjunction with the carrier 63, 62 and 61 and the shoe 65, as best seen in FIG. 9, so that as the shoe 65 is moved in a direction D20 that the carrier 61, 62 and 63 will also be moved in the direction D20. FIG. 9 therefore shows the path of the cable connecting the carrier described above.

In order to allow for the movement of the cable the unique pulley arrangement is illustrated in FIG. 10 wherein the cable will travel through the respective channels 107, 108 and 105*a* within the wheel 105, or through 106, 104, 105*a* within the opposite wheel or pulley 105. Assembly 101 is therefore provided which is affixed within the window frame via opening 101*a* and a fastener, not shown, which assembly allows for the movement of the cable and hence the carriers in a manner as best seen in FIG. 9.

Referring now to FIGS. 11 and 12 there is provided a locking mechanism for the shaft 30 which may be used with any closure assembly. A handle assembly H is provided including a stationary portion H2 fixed to the sash 21 and a moveable spring biased portion H1 biased to a continual locked position via spring leaf S2. The handle portion H1 includes a pivot H4 and detent portions H5 and H6. Normally the spring S2 will cause the handle portion H1 to remain in engagement at detents H5 and H6 with gear portion or serrations 30Z of the shaft 30. Therefore the window or door is locked in that position and cannot be pivoted or slid. When a user engages the handle H1 and presses it towards H2 the detents H5 and H6 release from the gears 30Z and hence the window or door may be repositioned as desired. At that repositioned location when the user releases the handles the window or door will again become locked.

As many changes can be made to the preferred embodiments of the invention without departing from the scope or intent thereof; it is intended that all matter contained herein be considered as illustrative of the invention and not in a limiting sense.

The embodiments of the invention in which an exclusive property or privilege is claimed are as follows:

1. A closure assembly having two ends comprising a first and second track disposed proximate each end of the assembly respectively, and a slidable and pivotable closure member, the closure member including framing sections therefor and being engaged with the first and second tracks proximate first and second pivots adjacent the pivotable end of the member, the first and second pivots being interconnected by a multiple segment shaft disposed within framing sections of said closure member, the shaft including at least two portions, the shaft providing for accurate installation, retention, removal, adjustment and alignment of the first and second pivots within the first and second tracks in a substantially parallel line with respect to one another and for pivotally supporting the closure member which may be safely and securely pivoted away from the closure assembly, whereby the first and second interconnected pivots are adapted to remain engaged with the first and second tracks while supporting the closure member both when it is pivoted away from the closure assembly and when it is slidable relative to the tracks.

2. The closure assembly of claim 1 further comprising a carrier traveling within each of said first and second tracks and having interconnected first and second portions disposed respectively within each of said first and second tracks, the first portion being engaged respectively with the first and second pivots of the closure member and the second portion being spaced from the first portion within each of the first and second tracks, the carrier to further assist sliding movement and pivoting movement of the closure member.

3. The closure assembly of claim 2 wherein the distance between said interconnected first and second portions is adjustable.

4. The closure assembly of claim 2 the first portion of the carrier traveling within each of said first and second tracks further comprises an opening within which the first or second pivots are disposed to cooperate with the first portion.

5. The closure assembly of claim 4 wherein the first and second pivots further comprises a rotatable pinion disposed therewith for facilitating the movement of the carrier relative to each of the first and second tracks.

6. The closure assembly of claim 5 wherein the rotatable pinion moves in cooperation with a rack disposed with each of said first and second tracks.

7. The closure assembly of claim 1, 2, or 5 wherein the closure member further comprises latching means for latching the closure member in relation to the carrier to prevent pivoting of the closure member when the closure member is slidable relative to the tracks.

8. The closure assembly of claim 7 wherein the latching means is a central locking member disposed with the framing sections of the closure member.

9. A pivoting and sliding closure assembly comprising:

i) an opening extending within a frame ii) the frame having two ends and having disposed therein or attached thereto proximate each end track portions extending in a substantially parallel direction to said frame;

iii) at least one closure member having framing portions and two ends and being slidable within said track portions and pivotable proximate at least one end thereof and latchable in the track portions proximate the other end thereof;

iv) each of said track portions having disposed therein at least one pivot shoe adjacent the pivoting end of the closure member, each shoe being substantially compatibly shaped with the track portions and having a top and bottom, each shoe having disposed therein adjacent the pivoting end of the at least one closure member an opening extending from the top toward the bottom of the shoe wherein pivot means are disposed, said pivot means provided with said pivot shoe being interconnected by a multiple segment shaft disposed within said framing portions of said at least one closure member, the shaft including at least two portions, the shaft providing for accurate installation, retention, removal, adjustment and alignment of the first and second pivots within the track portions in a substantially parallel line for pivotally supporting the at least one closure member for safe and secure pivoting away from the closure assembly;

v) the at least one closure member having latching means provided therewith for latching the at least one closure member in relation to the track portions to prevent the at least one closure member from pivoting upon the pivot means when the at least one closure member remains slidable with said track portions;

vi) the at least one closure member being braced by the multiple segment shaft interconnecting the pivot means disposed with each track portions, the substantially parallel alignment of the pivot means provided by the multiple segment shaft preventing the pivot means from misaligning or disengaging from the relevant track portions when the at least one closure member is rotated to an open position or when it remains slidable within said track.

10. The closure assembly of claim 9 wherein the pivot shoes have rolling means disposed adjacent the bottom thereof for assisting the movement of the pivot shoe.

11. The closure assembly of claim 9 wherein the pivot means further comprises a rotatable pinion for facilitating the movement thereof relative to the track.

12. The closure assembly of claim 9 wherein the latching means is a central locking member disposed with the framing portions of the at least one closure member.

13. The closure assembly of claim 9 wherein the pinion moves in cooperation with a rack disposed with said track.

14. The closure assembly of claim 1 or 9 wherein said closure assembly further comprise a window sash being a casement window.

15. The closure assembly of claim 9 wherein Jambs headers and sills are provided with said frame and said closure member further comprises a window sash.

16. The closure assembly of claim 9 wherein Jambs headers and sills are provided with said frame and said closure member further comprises a door.

17. The closure assembly of claim 9 wherein Jambs headers and sills are provided with said frame and said closure member further comprises a patio door.

18. A pivoting and sliding closure assembly comprising:

i) an opening extending within a peripheral frame said peripheral frame including frame portions including a header portion, a sill portion and two vertically extending jamb portions interconnected to form said peripheral frame;

ii) two of the frame portions having disposed therewith track portions extending in a substantially parallel direction to the two frame portions;

iii) at least one closure member having two ends and framing portions and being slidable within said track portions and pivotable proximate at least one end thereof and latchable in the track portions proximate the other end thereof;

iv) each of the track portions having disposed therein adjacent the pivoting end of the at least one closure member, at least one pivot shoe, each pivot shoe being substantially compatibly shaped with the track portions and having a top and bottom, each pivot shoe having disposed therein adjacent the pivoting end of the at least one closure member an opening extending from the top toward the bottom of the shoe wherein pivot means are disposed, said pivot means being interconnected by a multiple segment shaft disposed within the said framing portions of said at least one closure member, the shaft including at least two portions, the shaft providing for accurate installation, retention, removal, adjustment and alignment of the pivot means in a substantially parallel line for pivotally supporting the at least one closure member for safe and secure pivoting away from the closure assembly;

v) the at least one closure member having latching means provided therewith for latching the at least one closure member in relation to the track portions to prevent the at least one closure member from pivoting upon its pivot means when the at least one closure member remains slidable with said track portions;

vi) the at least one closure member being braced by the multiple segment shaft which provides for accurate installation, retention, removal, adjustment and alignment of the interconnected pivot means disposed with each track portion, the substantially parallel line of the pivot means provided by the multiple segment shaft preventing the at least one closure member from misaligning or disengaging from the relevant track portion when rotated to an open position or when the at least one closure member remains slidable within said track portions.

19. The closure assembly of claim 18 wherein said closure member is a window sash being a casement installation.

20. The closure assembly of claim 18 wherein the latching means is a central locking member disposed with the closure member.

21. The closure assembly of claim 18 wherein the at least one closure member is a window sash being a double hung installation.

22. The closure assembly of claim 18 wherein said closure member is a door.

23. The closure assembly of claim 18 wherein said closure member is a patio door.

24. The closure assembly of claim 18 wherein the pivot means further comprises a rotatable pinion for facilitating the movement of the at least one closure member relative to the track.

25. The closure assembly of claim 24 wherein the pinion cooperates with a rack disposed with said track portions.

26. A pivoting and sliding closure assembly comprising a closure member slidable within a guiding channel and pivotable therefrom, the closure member having a substantially rectangular frame having a top and bottom, and having engaged at its top and bottom, proximate one end of the closure member, pivots for engaging a first and second shoe, and having disposed at the other end of the closure member proximate its top and bottom, user accessible means for engaging the guiding channel;

said shoes being slidable in said guiding channel and comprising a substantially rectangular body having a top and bottom thermoplastic material) and preferably having disposed proximate the bottom, said shoes having disposed therewith pivot means for facilitating the movement of the shoes relative to the track, said pivot means being interconnected by a multiple segment shaft disposed within said frame, the shaft including at least two portions which provides for accurate installation, retention, removal, adjustment and alignment of the pivot means with said track portions, each shoe having an opening for said pivot means, the opening extending from proximate the top towards the bottom of said shoe, whereby when the closure member pivots upon the pivot means away from the guide channel, it is braced from misalignment by the multiple segment shaft and by the interconnected pivot means disposed with each channel, the substantially parallel line of the pivots being provided by the multiple segment shaft when the closure member is rotated to an open position or when it remains slidable within said track.

27. The closure assembly of claim 26 wherein said user accessible means is a central lock.

28. The closure assembly of claim 26 wherein said shoes are made from thermoplastic material.

29. The closure assembly of claim 26 wherein said shoes have disposed proximate the bottom thereof at least one roller or wheel.

30. The closure assembly of claim 26 wherein the pivot means further comprises a rotatable pinion for facilitating the movement of the shoes relative to the track.

31. The closure assembly of claim 30 wherein said pinion moves in cooperation with a rack disposed with said track.

32. The closure assembly of claim 26 wherein the interconnecting means engages with the edge of the framing sections for the closure member.

33. The closure assembly of claim 26 wherein said closure member is a window sash.

34. The closure assembly of claim 26 wherein said closure member is a door.

35. The closure assembly of claim 26 wherein said closure member is a patio door.

36. Hardware for a closure assembly, said closure assembly having a track and a slidable and pivotable closure member, the closure member having framing portions and being engaged with the track proximate first and second pivots adjacent the pivotable end of the member, the hardware comprising the first and second pivots being interconnected by a multiple segment shaft for installation within the framing portions of said closure member when the hardware is installed in said closure assembly, said shaft including at least two portions, the shaft providing for accurate installation, retention, removal, adjustment and alignment of the first and second pivots in a substantially parallel line for pivotally supporting the closure member when the hardware is installed in the closure assembly so that it may be safely and securely pivoted away from the closure assembly, whereby the first and second interconnected pivots when the hardware is installed in the closure assembly are adapted to remain engaged with the track while supporting the closure member both when it is pivoted away from the closure assembly and when it is slidable relative to the track.

37. The assembly of claim 1, 9, 18, or 26 further comprising a resiliently biased lock and handle which normally locks with detents disposed with the shaft of the assembly in operation until the handle is operated by a user wherein the lock unlocks with detents disposed with the shaft and allows the shaft to rotate, and when the handle is released again said lock locks with detents disposed with the shaft, allowing for continuous locking of the window at any position.

38. The hardware of claim 36 further comprising a resiliently biased lock and handle which normally locks with detents disposed with the shaft of the assembly in operation until the handle is operated by a user wherein the lock unlocks with detents disposed with the shaft and allows the shaft to rotate, and when the handle is released again said lock locks with detents disposed with the shaft, allowing for continuous locking of the window at any position.

39. The assembly of claim 1, 9, 18, or 26 further comprising an inside rack portion provided within the track assembly wherein when embodied in a tilt and slide or double hung window the inside rack portion extends the full width of the frame, and curves towards the stationary closed position for the window assembly and provides a closed window assembly in which both sashes are oriented in a straight line.

40. The assembly of claim 1, 9, 18, or 26 embodied in a casement window wherein a link having two ends is fastened at one end proximate the center of the bottom of the window sash and proximate the other end of the link adjacent the end of the sill of the window frame to allow for full operation of the casement window from a fully closed to a fully open position and the movement of the pivoting end of the window towards the opposite end so as to allow full access to the outside of the window and the easy cleaning thereof.

41. The assembly of claim 40 wherein the link is removable to allow total reversing of the window for cleaning and/or removal purpose.

42. The assembly of claim 1, 9, 18, or 26 embodied in a window assembly wherein a retractable screen is provided disposed within a frame portion of the assembly which accumulates on and pays out from a spring biased roll disposed within said frame portion, the screen being retractable for egress or cleaning purposes, and available as desired by providing a detent on the opposite frame portion engageable with the screen when in its operatable position.

43. The assembly of claim 1, 9, 18, or 26 wherein a rack is disposed with the track, said rack being made from aluminum and formed in three separate steps so as to minimize the amount of vertical creeping of the rack when formed.

44. The assembly of claim 43 wherein the rack also acts as a liner to distribute the load of the sash and minimize distortion of preferred vinyl extrusions.

45. The closure assembly of claim 1 or 9 wherein said closure assembly further comprise a window sash being a double hung window.

46. The closure assembly of claim 1 or 9 wherein said closure assembly further comprise a window sash being a tilt and slide window.

47. The closure assembly of claim 18 wherein the at least one closure member is a window sash being a tilt and slide installation.

* * * * *